US005285799A

United States Patent [19]

Minard

[11] Patent Number: 5,285,799

[45] Date of Patent: Feb. 15, 1994

[54] METHOD FOR PREVENTING DEPOSIT OF LIPSTICK ON TEETH

[76] Inventor: Donna Minard, 351 N. Newport Blvd. #525, Newport Beach, Calif. 92663

[21] Appl. No.: 898,533

[22] Filed: Jun. 15, 1992

Related U.S. Application Data

[62] Division of Ser. No. 594,609, Oct. 9, 1990, abandoned.

[51] Int. Cl.[5] ..... A45D 24/00

[52] U.S. Cl. ..... 132/200; 132/319; 132/320

[58] Field of Search ..... 132/200, 317, 318, 319, 132/320, 333; 604/1

[56] References Cited

U.S. PATENT DOCUMENTS

| | | | |
|---|---|---|---|
| 1,682,657 | 8/1928 | Blank | 604/1 |
| 1,735,221 | 11/1929 | Temple | 132/319 |
| 2,218,738 | 10/1940 | Boysen | 132/320 |
| 2,372,777 | 4/1945 | Gorman | 132/320 |
| 2,735,435 | 2/1956 | Feinstein | 132/320 |
| 4,213,472 | 7/1980 | Gueret et al. | 132/320 |
| 4,705,514 | 11/1987 | Barnard | 604/1 |
| 4,797,936 | 1/1989 | Zango | 132/320 |
| 5,000,202 | 3/1991 | Stepan | 132/320 |
| 5,020,553 | 6/1991 | De La Rocha | 132/320 |
| 5,044,040 | 9/1991 | Tetrault | 604/1 |

*Primary Examiner*—Gene Mancene
*Assistant Examiner*—Frank A. LaViola
*Attorney, Agent, or Firm*—Frank L. Zugelter

[57] ABSTRACT

Applicators (15, 40) for depositing mascara (16) on an eyelash (17) and lipstick (41) on a face (21), respectively, are disclosed, as well as methods of their applications. An absorbent tissue (47) is wrapped about one portion (45) of a properly circumferentially-sized applicator (40). After lipstick (41) is applied to the women's lips (43), they are puckered, tissue (47) on applicator (40) inserted into her mouth, and excess deposit of lipstick (41) is absorbed by tissue (47) without it depositing upon her teeth (42). The second applicator (15) comprises a curvi-lineared edge 22 which correlates to (by crossing) the line of the lower eyelash (17) after which mascara (16) from a brush (39) is evenly and properly applied to the eyelash (17). Face (21) below edge (22) is contoured to fit the flesh portion (24) of the eye socket (25).

2 Claims, 2 Drawing Sheets

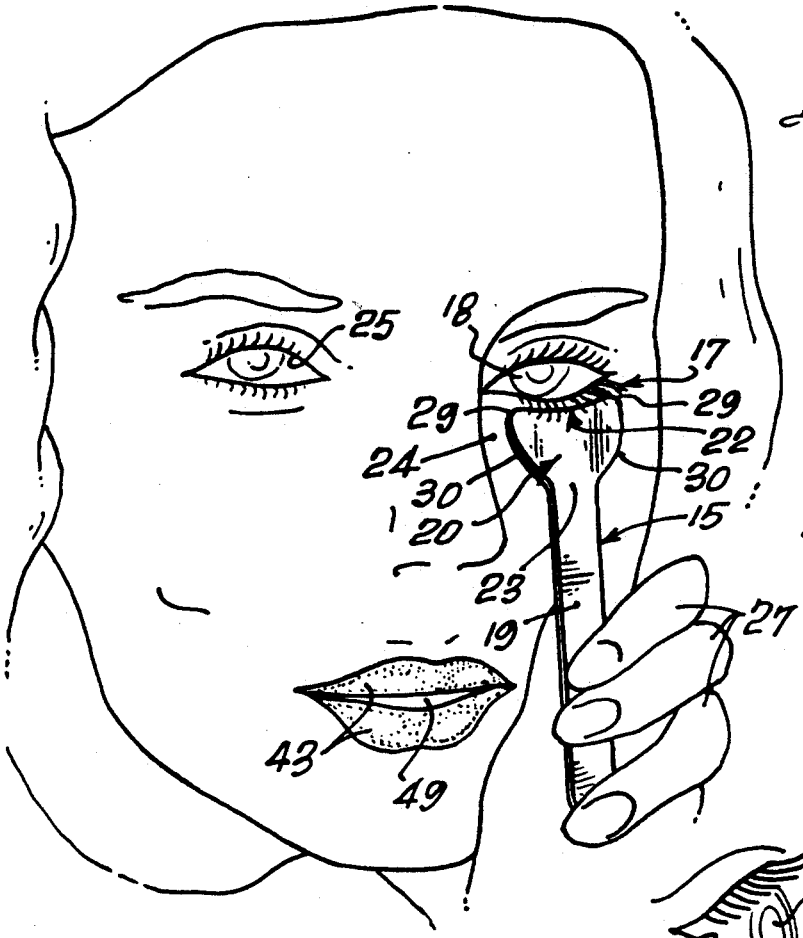
FIG. 1.
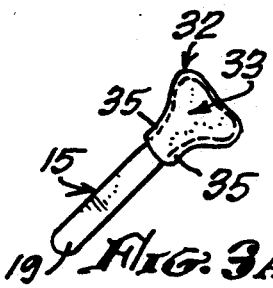
FIG. 3A.
FIG. 2.
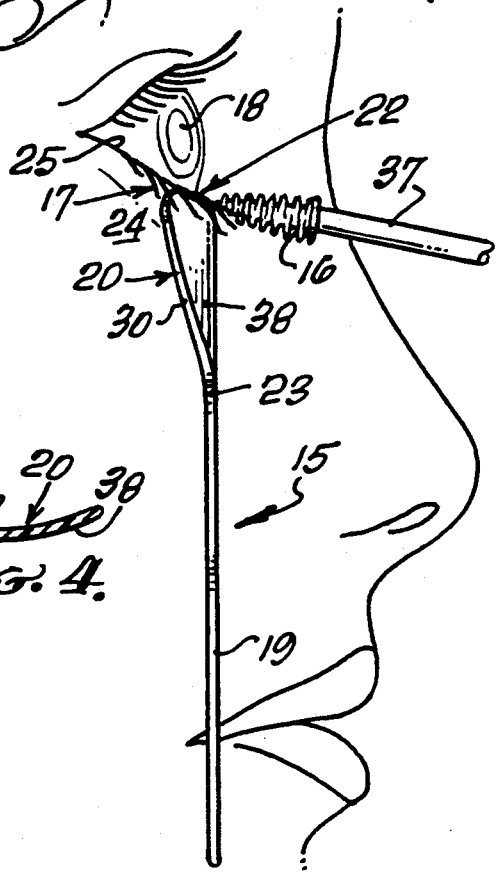
FIG. 3.
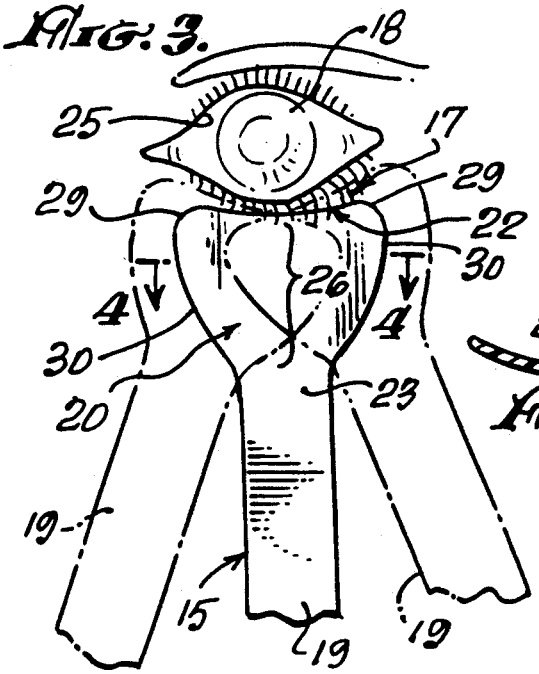
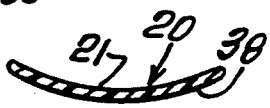
FIG. 4.

METHOD FOR PREVENTING DEPOSIT OF LIPSTICK ON TEETH

This application is a divisional application of my application, Ser. No. 07/594,609, filed Oct. 9, 1990, now abandoned.

TECHNICAL FIELD

This invention is directed to guards and protectors for and methods of preventing deposit of lipstick on one's teeth and removing excess lipstick and to protectors or shield for efficiently applying mascara to the lower eyelids about a person's eyes.

BACKGROUND ART

Various protectors and guards and methods of application are disclosed in the following prior-art-teachings: U.S. Pat. Nos. 1,456,394; 1,529,690; 1,682,657; 2,218,862; 2,556,815; 2,774,983; 2,842,790; 2,983,944; 3,090,064; and 3,413,673.

DISCLOSURE OF THE INVENTION

The subject matter of the invention are methods with and devices useful to cosmetic goals associated with a woman's facial features, i.e., beautifying them, and in particular, with regard to lipstick applied to her lips and mascara applied to her eyelids. In reference to the device for the lips, this invention solves the problem of the deposit of lipstick that is found on her teeth with conventional application of lipstick to her lips (from a tube usually), and which she usually removes by facial tissue or hankerchief after application of the lipstick to the lips. However, lipstick deposits nevertheless, usually would appear on the teeth thereafter. The method and device of this invention eliminate the deposition of lipstick on the teeth while simultaneously removing any excess of lipstick once applied to the lips. A tissue is mounted to its carrier mounted on a handle and then thrust into an opened mouth the coated lips of which then being puckered.

The puckered coated lips are pressed to or about the tissue, excess of lipstick thence being deposited upon the tissue. Withdrawal of carrier and soiled tissue shows that no deposit of lipstick is found on the teeth.

The device comprises an elongated member for mounting or carrying the tissue on it, circular in nature and of such a circumferential size that the tissue it carries presents itself as full as possible to the surface areas of both puckered coated lips and thereby whisk off the excess lipstick. A handle is mounted to the carrier and is of a length and size easily grasped by one's fingers.

In reference to the protector that is applied to one's lower pair of eyelashes, it is known to be a problem to provide a distribution of mascara on each eyelash, particularly as to the lower ones, without it clumping or smudging or being applied to the flesh portion above the cheek bone and below the eye's socket. This protector is a uniquely-configured article which is inserted immediately under the lower eyelash of an eye, after which mascara from a brush or the like is readily applied to such eyelash, eliminating smudging and extraneous deposits. The protector is configured to the eye socket and to such eyelash, having its applicating edge and face so contoured as to smoothly distribute mascara onto the eyelash. Thus, no excess mascara need be removed after utilization of this applicator, as in the process of application a uniform mascara deposit is effected only on the eyelash.

An object of this invention is to provide novel articles for eliminating excess lipstick and mascara on a wearer's facial features.

Another object of this invention is to provide novel methods for preventing deposit of and/or removing excess lipstick from and smoothly distributing mascara to a wearer's facial features.

These objects and advantages will become more apparent upon a full and complete reading of the following description, appended claims thereto, and the accompanying drawing comprising two (2) sheets of nine (9) FIGURES.

BRIEF DESCRIPTION OF THE DRAWING

FIG. 1 is a perspective view of a protector or shield embodying the invention and being shown applied to one's lower eyelash of a woman's (left) eye.

FIG. 2 is a view from the side of the woman's face of FIG. 1, showing the position of the protecor or shield under her one lower (right) eyelash as a mascara brush is applying mascara to it.

FIG. 3 is a view illustrating various positions that may be utilized for the protector or shield while applying mascara to the lower eyelash of an eye.

FIG. 3A is a perspective view of an alternative embodiment of the article or guard of FIGS. 1-3.

FIG. 4 is a view taken on line 4—4 of FIG. 3.

BEST MODE FOR CARRYING OUT THE INVENTION

Figure 5:
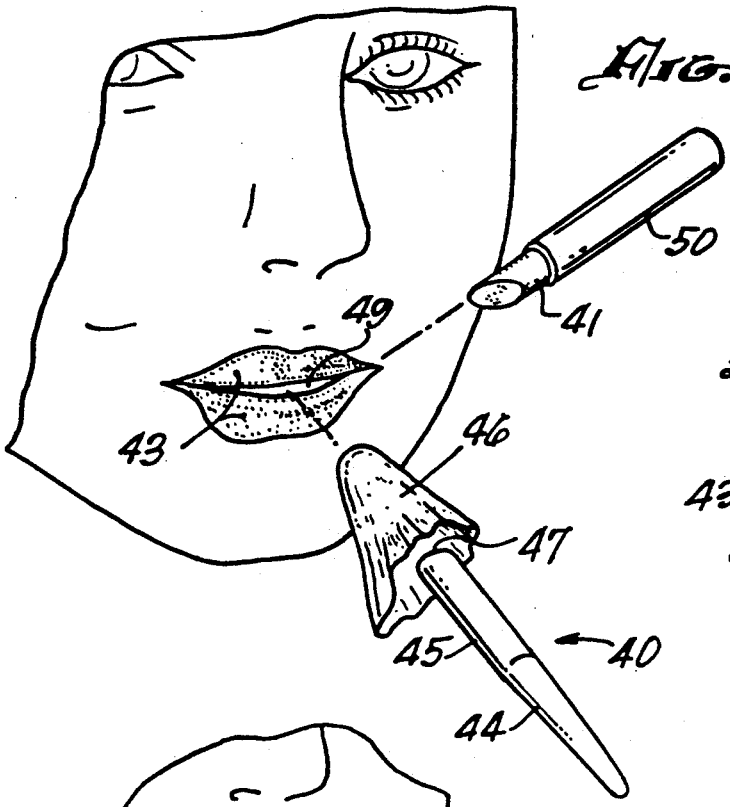
FIG. 5 is a perspective view of another article or guard in preparation for its article or guard to remove excess lipstick applied to the woman's lips while preventing or eliminating deposit of lipstick on her teeth.
Figure 8:
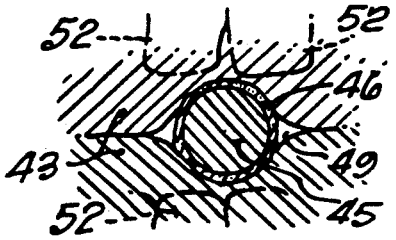
FIG. 8 is a view taken on line 8—8 of FIG. 7.
Figure 6:
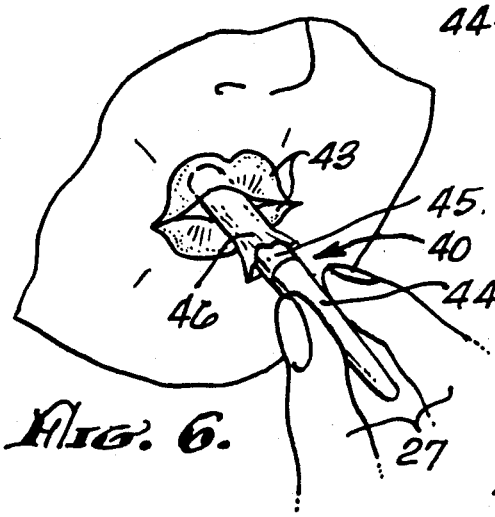
FIG. 6 is a perspective of such article or guard in one position of application.
Figure 7:
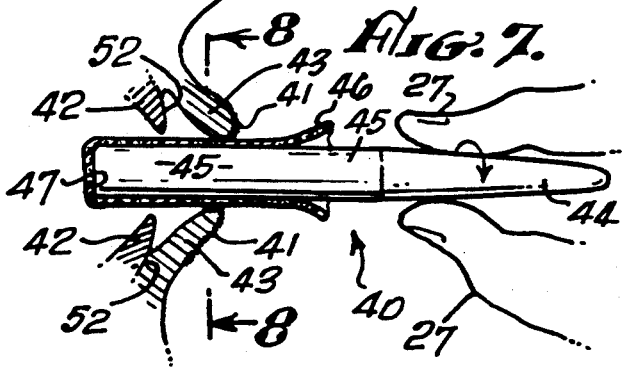
FIG. 7 is an elevational fragmentary view, partly cut away, of the article or guard in its position shown in FIG. 6.
Figure 9:
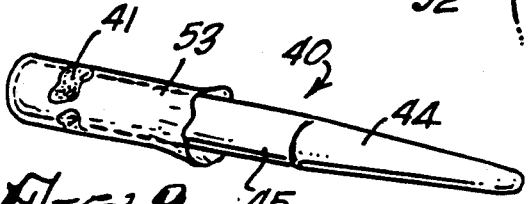
FIG. 9 is a perspective view of the article or guard after it has been used and removed from the mouth of the woman.

Referring now to the accompanying drawing wherein reference characters correspond to like numerals hereinafter, FIGS. 1-5 illustrate a shield 15 by which mascara 16 (FIG. 2) is applied to a lower eyelash 17 of a woman's eye 18.

Shield 15 comprises a handle 19 in a stick-like configuration and a shielding head 20 mounted to handle 19, preferably integrally thereto. Head 20 includes a shallowly scalloped or slightly curved face 21 (FIG. 4) extending from an engaging edge 22 to its neck 23 at which it is securely mounted to handle 19. Face 21 and edge 22 are configured or contoured to the user's flesh portion 24 of the eye's socket 25 (above the cheek bone), immediately below eye 18, and includes a dimension 26 (FIG. 3) sufficiently long or deep, before reaching neck 23, to provide, with engaging edge 22 a surface area that fits comfortably to such flesh portion or facial contour 24 while providing a tactile sense admitting to the user's hand or fingers 27 that the device is properly, in addition to comfortably, in place for application of mascara. Engaging edge 22 includes also a depression or curvi-linear length 2B extending between its two points of termini 29 around which such edge generates into corresponding peripheral edges 30 disposed below length 28 and which in turn correspondingly extend to handle 19 at neck 23. Curvi-linear length 28 duplicates or parallels the contour of eyelash 17 while also incorporating the scalloping contour of face 21 in order that the application of edge 22 in relation to an eyelash 17 results in a proper disposition of such edge 22, as by crossing, to eyelash 17 for the next step in applying the mascara.

Length 28 of engaging edge 22 approximates a distance a bit less than the full line (length) of eyelash 17 of eye 18, and to which protector 15 is to be applied, as it will be observed from FIGS. 1 and 3 that in the use of protector 15, such edge 22 is thereby readily swung or moveable to-and-fro across the flesh portion 24 immediately below the eyelash 17 to which mascara 16 is to be applied, all of which makes the application of mascara easier to its user.

Face 21, between the boundaries of edge 22 and neck 23 and peripheral edges 30, as mentioned above, is provided with a sufficient curvature or scalloping across the width of head 20, while its edge 22 further corresponds with the curvature of the line of the eyelash 17 immediately above it, in order that engaging edge 22 properly aligns under the single, double or triple rows (from the margin of the eyelid) of short, (relatively) thick, downwardly curved hairs forming such lower eyelash 17. The line of eyelash 17 crosses the lengths of these curved hairs themselves, and thus, engaging edge 22 must seat under or directly engage such eyelash line and across the lengths of these curved hairs while face 21 comfortably engages flesh portion 24.

An alternative embodiment of applicator 15 is illustrated in FIG. 3A, wherein a disposable cover 32 is mounted over the head 20. Disposable cover 32 comprises a glove-like article 33 containing a pocket into which head 20 is inserted for disposition therein, the pocket formed by material or fabric stretchable in its nature so that its neck 35, smaller in dimension than the greatest width of head 20, may stretch over such head for disposition upon or about neck 23 of applicator 15. Cover 32 itself is utilized in the application of mascara 16 to lower eyelash 17, after which it may be discarded as a disposable item, thereby maintaining continuing cleanliness to the protector itself without the necessity of cleaning mascara from it.

In practice of the invention, with or without cover 32 on head 20, fingers 27 of the woman's hand grasps handle 19 of protector 15 and moves head 20 into proximity to and below an eye socket 25. As she does so, hand 27 moves the leading or engaging edge 22 and face 21 of protector 15 to a direct engagement with the flesh portion 24 immediately below eyelash 17, or the hand causes edge 22 itself to directly engage eyelash 17, depending primarily upon the comfort level the women desires and receives through her tactile sense with the protector 15 to her facial features. Edge 22 now crosses the lengths of the downwardly curved hairs forming lower eyelash 17 of eye 18. While holding edge 22 in place under or to eyelash 17, mascara 16 from a brush 37 is applied directly to the curved hairs forming the line of eyelash 17, smoothly distributing such cosmetic while readily brushing away excessive amounts thereof that are deposited upon the back 38 of head 20 or on cover 32 should the latter envelop head 20. Smudging also is eliminated. After application is completed, hand 27 removes protector 15 from underneath eye socket 25.

FIG. 3 illustrates various positions for protector 15 as it is applied to eyelash 17. Movement of handle 19 (by hand) is seen to place the scalloped face 21 and its curvi-lineared edge 22 along different positions under and across the line of curved hairs forming eyelash 17 in order that application of mascara extends throughout the entire line of eyelash 17. The contoured edge and scalloped face of head 20 provides for convenient freedom of swinging movement to-and-fro about flesh portion 24 during the application of mascara.

Turning now to FIGS. 5–9, a guard 40 is illustrated, and is used to prevent deposit of lipstick 41 on teeth 42 (FIG. 7) while simultaneously removing excess lipstick 41 from the woman's lips 43. Guard 40 comprises a handle portion 44, an insertable carrier 45 mounted thereon, preferably integrally formed with handle portion 44 which extends therefrom, and an absorbent material or tissue 46 draped or wrapped about its carrier 45. Carrier 45's nature includes a peripheral portion of a size of construction such that the surface areas of a pair of puckered lips (FIG. 6) substantially embrace tissue 46 which is draped over the carrier and while carrier and tissue continue to retain or provide for a comfortable overall tactile sense with puckered lips and mouth. The peripheral portion of carrier 45 can be cylindrical, oval or other suitable geometrical configuration, as long as it functions to provide the expanse that dictates comfortability to the puckered lips and mouth as the former embrace tissue 46 on the carrier. Tissue 46 is carried by carrier 45 into the mouth, and the length of carrier 45 is such that it does not gag the user upon its insertion in the mouth. The end 47 of the inserted carrier 45 should pass but remain in proximity to the rows of teeth 42 to prevent such gaging, while the portion of tissue 46 at end 47 seats on or remains in proximity to end 47. Handle portion 44 may be of any suitable configuration and length for firm gripping by fingers 27 while applying guard 40 to its task.

Before utilization of guard 40, lipstick 41 from its tube 50, FIG. 5, is applied to the woman's lips 43, usually and conventionally performed manually by the woman herself. In past practice, after lipstick application to lips 43, a uniformed distribution of lipstick would appear throughout their (areal) surfaces. In that method, invariably lipstick would deposit upon the front surfaces 52, of her teeth 42, as well as perhaps elsewhere on facial contours exteriorly about her mouth. Consequently, it would be necessary to remove such lipstick from the teeth as well as any excess lipstick on and exteriorly surrounding her lips. A tissue or hankerchief would be applied directly to the teeth by the hand to accomplish such removal. Another method was placing a facial tissue between the lipstick-coated lips which then would be smacked down upon such tissue for removal of non-desired lipstick. This, however, did not eliminate or prevent the deposit of lipstick on her teeth.

In the present method of application of the instant subject matter of this invention, after lipstick 41 is applied to or coats the woman's pair of lips 43, they are opened and puckered. Tissue 46, FIG. 7, mounted on its carrier 45, is inserted into opened mouth 49. Lips 43 then are pressed about tissue 46, and it with the properly circumferentially-sized carrier 45 are embraced by the full extent of the puckered and coated lips, thereby removing excess lipstick on the surface areas of lips 43, while preventing deposit of lipstick on the front 52 of teeth 42, since tissue 46 itself, i.e., its portion within the mouth behind lips 43, absorbs such lipstick. Lips 43 then are removed from the tissue and carrier, such as by opening the mouth again, and tissue and carrier are withdrawn from the mouth.

Tissue 46 should not be of over-sized dimensions in terms of the user's mouth or insertable carrier 45. In the mounting of the tissue to carrier 45, it may be wrapped thereabouts as well as merely cloaking or being draped upon carrier 45 and its associated end 47. On the other hand, a closed umbrella effect, i.e., folds of tissue about portion 45 should not be sought. The proper sizing of portion 45's circumference is a measure for the amount of tissue 47 to be put about it, since the desired and proper circumferential size of the peripheral portion of carrier 45 is conducive to a properly sized tissue absorbing the widest extent of the puckered and coated lips which are to embrace the tissue 46.

While carrier 45 of guard 40 and absorbing tissue 46 are within mouth 49, and lips 43 puckered, guard 40 can be rotated manually by fingers 27, intermediate the pressing steps of puckered lips to tissue. Thereafter, by opening mouth 49, applicator 40 is free to be withdrawn by fingers 27. The lips are returned by the woman to their usual juxtapositional relationship to one another, and soiled tissue 53 (FIG. 9) is removed from applicator 15 and discarded. Guard 40 is again ready for use.

Various changes and modifications may be made without departing from the spirit or scope of the invention. For example, edge 22 may be a straight edge, with or without scalloping of face 21. Also, the axes of face and handle need not be coincident and/or lie generally in the same plane as shown; they may be angled to one another in various directions, the first (viewing FIG. 3) where the angle lies in the sheet of the drawing, clockwise or counterclockwise, and the second where the angle departs to either side of the plane of the drawing sheet and at any angle in such third dimension. Also, the face may be of a flat planar nature, with or without curvature of edge 22 to the line of eyelash 17. Further, the face and handle may not be of different widths as shown.

The materials from which devices 15, 40 are fabricated are light weight, comfortable to hand, flesh and mouth, of a non-taste and odorless material, and of non-toxic nature, such as plastic or wood, and which otherwise should not be detrimental to the health of the person using them. Guard 40 may be fabricated from Styrofoam and a suitable coating of an impervious nature, such as a water-based paint, absorbed by the Styrofoam. The resulting fabrication then nicely supports the tissue. Present day molding and milling equipment and techniques are available for fabricating the devices from plastic, wood or other suitable materials and the firmness required in such applicators, although they may be flexible (bendable) in nature should it be desired. Disposable tissues 46 may be pre-fabricated, and formed from linen, cotton, or any thin absorbing fabric, as well as including softness. Lipstick includes lipgloss and other coating for the lips.

INDUSTRIAL APPLICABILITY

This invention is applicable in the cosmetic industry, which sustains the make-up or appearances of millions of users, such as women and actors.

I claim:

1. A method of preventing deposit of lipstick on teeth in the interior of a person's mouth when a coating of lipstick is on the person's lips, comprising mounting an absorbent tissue about a carrier mounted on a handle, opening the lips of the person's mouth, puckering the lips, inserting the tissue on said carrier into the person's mouth, pressing the puckered lips against the tissue on the carrier, removing the lips from the tissue, and withdrawing from the mouth the tissue and its carrier.

2. The method of claim 1 including the step of rotating the carrier with the tissue on it while inserted in the person's mouth.

* * * * *